United States Patent [19]

Hänsch

[11] Patent Number: 4,811,938

[45] **Date of Patent: * Mar. 14, 1989**

[54] APPARATUS FOR COLLATING FOLDED PRINTED SIGNATURES

[75] Inventor: Egon Hänsch, Wetzikon, Switzerland

[73] Assignee: Ferag AG, Hinwil, Switzerland

[ * ] Notice: The portion of the term of this patent subsequent to Aug. 4, 2004 has been disclaimed.

[21] Appl. No.: 153,584

[22] Filed: Feb. 8, 1988

[30] Foreign Application Priority Data

Feb. 11, 1987 [CH] Switzerland ..... 00510/87

[51] Int. Cl.[4] ..... B65H 39/02

[52] U.S. Cl. ..... 270/54; 270/55

[58] Field of Search ..... 270/53, 54, 55, 56, 270/57, 58

[56] References Cited

U.S. PATENT DOCUMENTS 4,564,186 1/1986 Clarke, Jr. et al. ..... 270/54
4,605,213 8/1986 Hechler ..... 270/55
4,607,831 8/1986 Raybuck ..... 270/58
4,684,116 8/1987 Hänsch ..... 270/54

*Primary Examiner*—Robert E. Garrett
*Assistant Examiner*—Therese M. Newholm
*Attorney, Agent, or Firm*—Werner W. Kleeman

[57] ABSTRACT

Infeed devices serve to individually place in straddling formation printed signatures or sheets upon collating conveyors equipped with pusher entrainment members. There are provided a plurality of mutually parallelly extending collating conveyors arranged at a substantially uniform circumferential spacing from one another about an axis of revolution. These collating conveyors revolve about such axis of revolution. In order to obtain an essentially coincident or congruent alignment of the edges of the printed signatures or sheets during collation thereof there is provided at the region of the transfer location of each of the infeed devices an associated impact element in order to force the printed signatures or sheets against the associated pusher entrainment member.

13 Claims, 4 Drawing Sheets

APPARATUS FOR COLLATING FOLDED PRINTED SIGNATURES

CROSS-REFERENCE TO RELATED APPLICATIONS AND PATENTS

This application is related to the commonly assigned, co-pending U.S. application Ser. No. 06/889,221, now U.S. Pat. No. 4,732,374 filed July 25, 1986, entitled "Apparatus for Collating Folded Printed Products, Especially Signatures or Sheets", and the commonly assigned, co-pending U.S. application Ser. No. 07/031,663, now U.S. Pat. No. 4,743,005 filed Mar. 30, 1987, and entitled "Apparatus for Stuffing Inserts into Multi-Sheet Printed Products". This application is also related to the commonly assigned U.S. Pat. No. 4,684,116, granted Aug. 4, 1987, entitled "Method and Apparatus for Collating Folded Printed Signatures Using Conveyors Rotating about a Central Axis" and the commonly assigned U.S. Pat. No. 4,684,117, granted Aug. 4, 1987, and entitled "Method and Apparatus for Opening Printed Products Which Have Been Folded Off-Center". Reference may be had to the aforementioned applications and patents and the disclosures of which are incorporated herein by reference.

BACKGROUND OF THE INVENTION

The present invention broadly relates to a new and improved apparatus for collating folded printed products, especially signatures or sheets.

In its more particular aspects, the present invention concerns a new and improved apparatus for collating folded printed signatures or sheets in which the printed signatures or sheets are deposited in each case in a straddling position or posture by a number of infeed devices or feeding conveyors upon collating conveyors provided with pusher or pushing entrainment members. There are provided a plurality of such collating conveyors which extend substantially parallel to one another at a substantially uniform or equidistant circumferential spacing from one another about an axis of revolution or rotation. These collating conveyors revolve or rotate about such axis of revolution or rotation.

Such type of collating apparatus is disclosed in the German Published Pat. No. 3,620,945.7, or the extensively cognate British Published Patent Application No. 2,177,380, and the aforementioned corresponding U.S. Pat. No. 4,684,116, granted Aug. 4, 1987. In contrast to other prior art collating apparatuses, for instance as disclosed in Swiss Patent No. 535,696, granted Apr. 15, 1973, and Swiss Patent No. 650,729, granted Aug. 15, 1985, which possess only a single, as a general rule linear collating conveyor, the initially referred to collating conveyor as disclosed in the aforementioned U.S. Pat. No. 4,684,116, is capable of collating appreciably more printed signatures or sheets per unit of time. This is attributable to the fact that each of the collating conveyors, during its movement between two neighboring infeed devices, accomplishes one revolution about the axis of revolution or rotation and the entrainment members of such collating conveyors, during such revolving motion, are advanced or forwardly displaced by an amount corresponding to the spacing from the next downstream located infeed device. Viewed in space the entrainment members thus describe a helical or spiral-shaped path of travel. Therefore, the infeed devices can deliver the folded printed signatures or sheets practically in the same number per unit of time as such are outputted, for instance, by an upstream arranged printing press. The entrainment members thus can be advanced relatively slowly, in other words, without there existing the danger of damaging the printed signatures or sheets.

What is important to take cognizance of with respect to the heretofore known collating apparatus is that the infeed devices deposit the printed signatures or sheets upon the collating conveyors moving therepast such that they always come to lie forwardly or downstream of one of the arriving pusher entrainment members. This is only possible if the infeed devices and the collating conveyors are controlled and synchronized or coordinated with respect to one another such that the printed signatures or sheets come to lie at a spacing, even if the same is small, forwardly of the just arriving entrainment member of the relevant collating conveyor. In other words, a certain distance or spacing prevails between the arriving entrainment member and the trailing edge of the printed signature or sheet as viewed in the direction of conveyance of the collating conveyor.

As far as the initially deposited printed signature or sheet is concerned this is of no great significance. This is so because the point or location of deposition upon the collating conveyor does not move since this first deposited printed signature or sheet, following its placement upon the associated collating conveyor, so-to-speak remains "stationary", that is to say, does not move relative to the collating conveyor upon which it is deposited, until it is again so-to-speak "passed" or "caught up with" by the associated pusher entrainment member and only then will such previously deposited printed signature or sheet be forwardly displaced or advanced. However, as far as each further printed signature or sheet is concerned, which comes to bear upon a previously deposited printed signature or sheet, this aforedescribed spacing is of significance. This is so because each of such further deposited printed signatures or sheets, by virtue of the friction prevailing between such further deposited printed sheet and the printed sheet disposed therebelow, can be forwardly advanced or displaced from the moment that it is laid upon the previously deposited printed signature or sheet without such further or subsequent deposited printed signature or sheet directly contacting or bearing at the pusher entrainment member. The result of this type of operation is that the edges of the printed signatures or sheets collated by the collating conveyors are not congruently aligned or squared up with respect to one another. As a result, there exists the necessity of aligning or squaring up the groups of printed signatures or sheets which have been collated at the collating conveyors of the heretofore known apparatus prior to performing the next intended operation, for instance, prior to stapling or stitching or otherwise binding together the collated printed signature or sheets.

SUMMARY OF THE INVENTION

Therefore with the foregoing in mind it is a primary object of the present invention to provide a new and improved collating apparatus for collating printed products, especially signatures or sheets, which does not exhibit the aforementioned drawbacks and shortcomings of the prior art constructions.

Another and more specific object of the present invention aims at the provision of a collating apparatus of the previously mentioned type which is structured such that it ensures that the edges of the printed signatures or sheets which border the fold or fold region of such printed signatures or sheets, and which printed signatures or sheets have been collated at the collating conveyors into groups, are coincidentally aligned or squared up with regard to one another.

Still a further noteworthy object of the present invention is directed to the provision of a new and improved construction of collating apparatus for collating predeterminate products, especially printed signatures or sheets, in a manner such that the individual groups of collated printed signatures or sheets are effectively co-terminously or coincidentlly aligned at their edges with one another, to thereby eliminate the necessity of performing such alignment or squaring up operation at a later point in time before continuing with further processing of the collated printed signatures or sheets.

Yet a further decisive object of the present invention is directed to an improved construction of collating apparatus for collating printed products, especially printed signatures or sheets, which collating apparatus is relatively simple in construction and design, quite economical to manufacture, highly reliable in operation, capable of producing essentially squared up or congruent groups of collated printed signatures or sheets, not readily subject to breakdown or malfunction, and requires a minimum of maintenance and servicing.

Now in order to implement these and still further objects of the invention, which will become more readily apparent as the description proceeds, the apparatus for collating folded printed products, especially printed signatures or sheets, as contemplated by the present invention, is manifested by the features that at the region of the transfer location of each of the infeed devices where there are transferred the printed signatures or sheets to the collating conveyors there are arranged impact elements which are deflectable or movable in the direction of revolution of the collating conveyors in order to force the printed signatures or sheets against the related pusher entrainment member.

By virtue of the impact elements or impact means which are essentially stationary in axial direction of the collating apparatus a printed signature or sheet is prevented from advancing or moving forwardly only by virtue of the friction prevailing between such printed signature or sheet and the printed signature or sheet situated therebelow and, in fact, is held back or retained until the pusher or pushing entrainment member also directly impinges or impacts against the last deposited printed signature or sheet. Consequently, the edges of the printed signatures or sheets which have been deposited upon one another or collated are essentially coincidentally aligned or squared up in relation to one another, in other words, are essentially congruent to one another.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
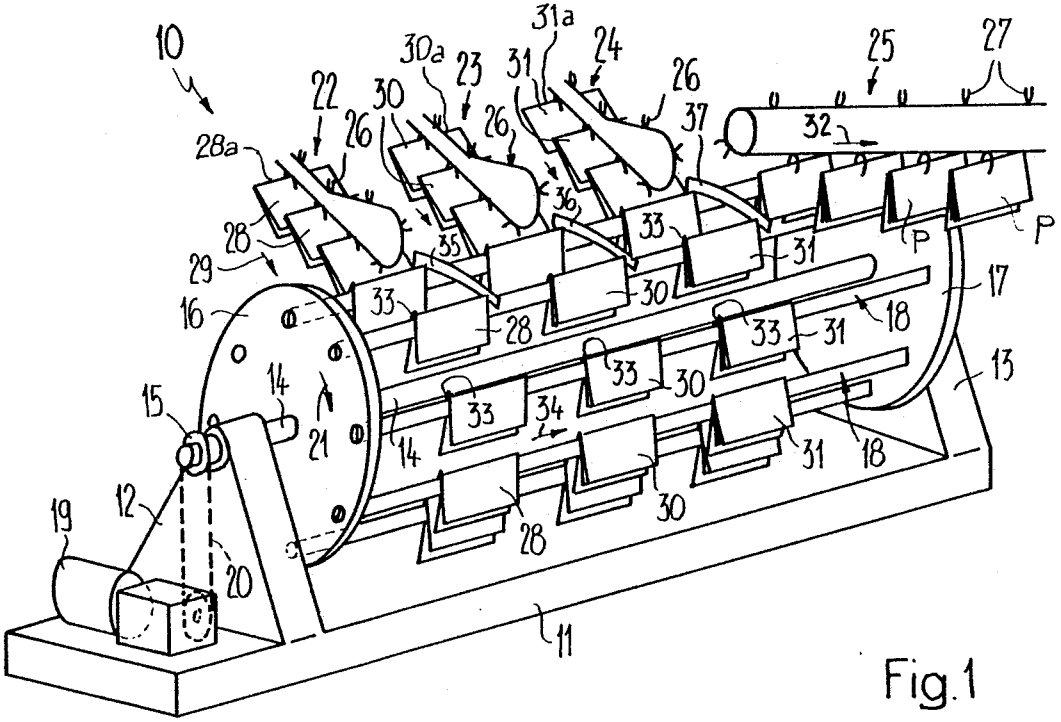
FIG. 1 is a simplified perspective view of a collating apparatus for collating printed products, here shown in the form of printed signatures or sheets, and constructed according to the present invention.

Describing now the drawings, it is to be understood that to simplify the showing thereof, only enough of the structure of the collating apparatus for collating folded printed products, especially signatures or sheets, has been illustrated therein as is needed to enable one skilled in the art to readily understand the underlying principles and concepts of this invention. Turning now specifically to FIG. 1 of the drawings, there has been depicted an exemplary embodiment of collating apparatus, generally indicated in its entirety by reference character 10, the construction of which corresponds to a great extent to the construction of collating apparatus disclosed in the aforementioned commonly assigned U.S. Pat. No. 4,684,116, granted Aug. 4, 1987, to which, as stated, reference may be had and the disclosure of which is incorporated herein by reference. Therefore, in the description to follow, there will be first generally discussed the construction of such collating apparatus 10 and then there will be specifically explained details of the construction and features of the present invention which result in the advantageous squaring up or essentially coincident alignment or co-terminous positioning of groups of collated printed signatures or sheets.

Reverting now more specifically to FIG. 1, the collating apparatus 10 will be seen to comprise a base or socket 11 or equivalent support structure, at each opposed or opposite situated end of which there is provided a respective bearing pedestal or bracket 12 and 13. In these bearing pedestals or brackets 12 and 13 there is rotatably mounted a shaft or shaft member 14 which protrudes beyond the bearing pedestal or bracket 12, as shown in FIG. 1, and at that location carries a sprocket wheel 15 or the like. Between the bearing pedestals or brackets 12 and 13 there are seated at the end regions of the shaft or shaft member 14 two support or mounting members, here shown as disc members 16 and 17 which are rigidly connected for rotation with the shaft or shaft member 14 defining an axis of revolution or rotation. At the circumferential region of each of the disc members 16 and 17 there are rotatably mounted the ends of the collating conveyors 18. These collating conveyors 18 or equivalent collating devices, are arranged at a substantially uniform or equidistant circumferential spacing from one another along a circle which is concentric to the shaft or shaft member 14. In the portrayal of the collating apparatus 10 as shown in FIG. 1 there have only been conveniently depicted five such revolving collating conveyors 18 for simplicity and clarity of the illustration, although in reality an appreciably greater number of such collating conveyors 18 can be provided for the collating apparatus 10, and the arc length between neighboring collating conveyors 18 can amount to, for instance, approximately 10 to 30 cm.

Figure 4:
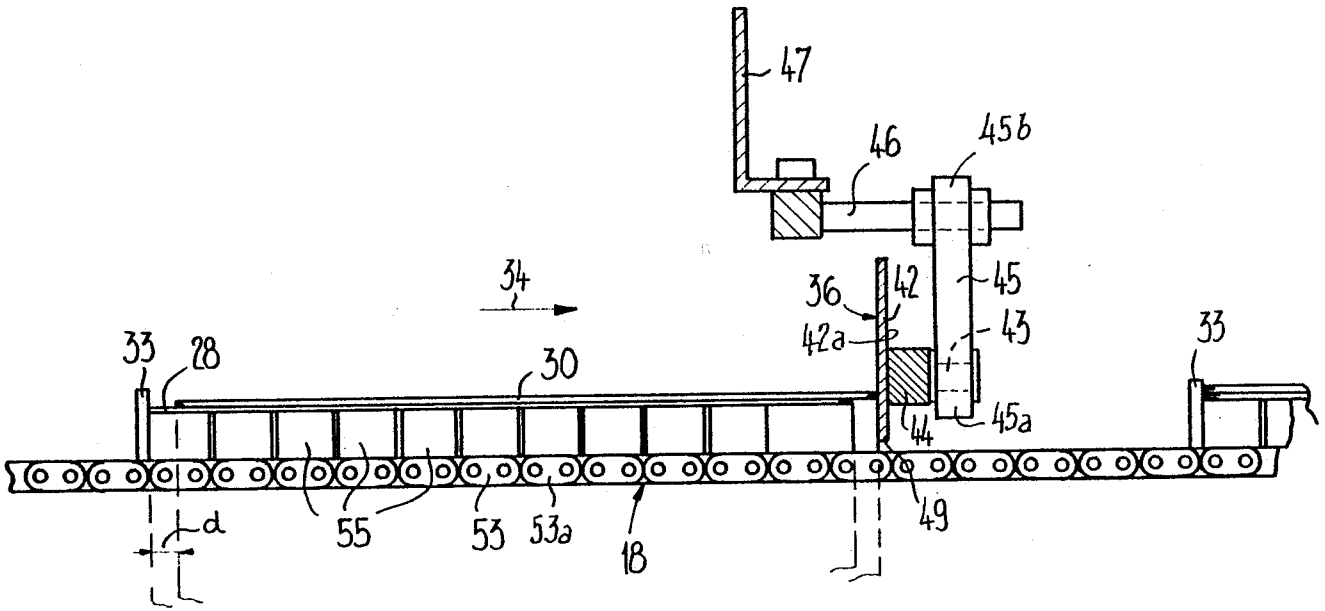
FIG. 4 is a simplified cross-sectional view of the arrangement of FIG. 2, taken substantially along the section line IV—IV thereof.

In the showing of the collating apparatus 10 in FIG. 1, the collating conveyors 18 have been simply conveniently representatively depicted as rods; however as will be apparent from the illustration of FIG. 4 the same are constituted, by way of example and not limitation, by endless revolving or moving link chains 53. Furthermore, appropriate means or expedients are provided, as disclosed in the aforementioned commonly assigned U.S. Pat. No. 4,684,116, granted Aug. 4, 1987, which ensure that all of the collating conveyors 18 always have the same orientation or posture independent of their momentary or current position.

The shaft or shaft member 14 and thus the disc members 16 and 17 are driven by a suitable gearing or transmission motor 19 or equivalent drive structure through the action of a chain 20 and the sprocket wheel 15 in the direction of the arrow 21 (FIG. 1) so that each of the collating conveyors 18 revolves along a circular path of travel about the shaft or shaft member 14 defining the aforementioned axis of revolution or rotation.

As part of the collating apparatus 10 depicted in FIG. 1 there are provided, by way of example, three infeed devices or feeding conveyors 22, 23 and 24 and a product withdrawal or outfeed device or conveyor 25. The infeed devices 22, 23 and 24 are each equipped with suitable controlled grippers or gripper elements 26 and the product withdrawal or outfeed device or conveyor 25 is likewise provided with suitable controlled grippers or gripper elements 27. The infeed device 22 delivers folded printed signatures or sheets 28 in a suspended or depending position in the direction of the arrow 29 in that each of its gripper elements 26 engages with one of the printed signatures or sheets 28 at its fold or fold region 28*a*. In similar fashion, the infeed device 23 delivers or infeeds folded printed signatures or sheets 30 engaged by the gripper elements 26 at the fold or fold regions 30*a* and this is equally so for the infeed device 24 which delivers or infeeds the folded printed signatures or sheets 31 which are engaged at their fold regions 31*a* by the associated gripper elements 26.

Figure 2:
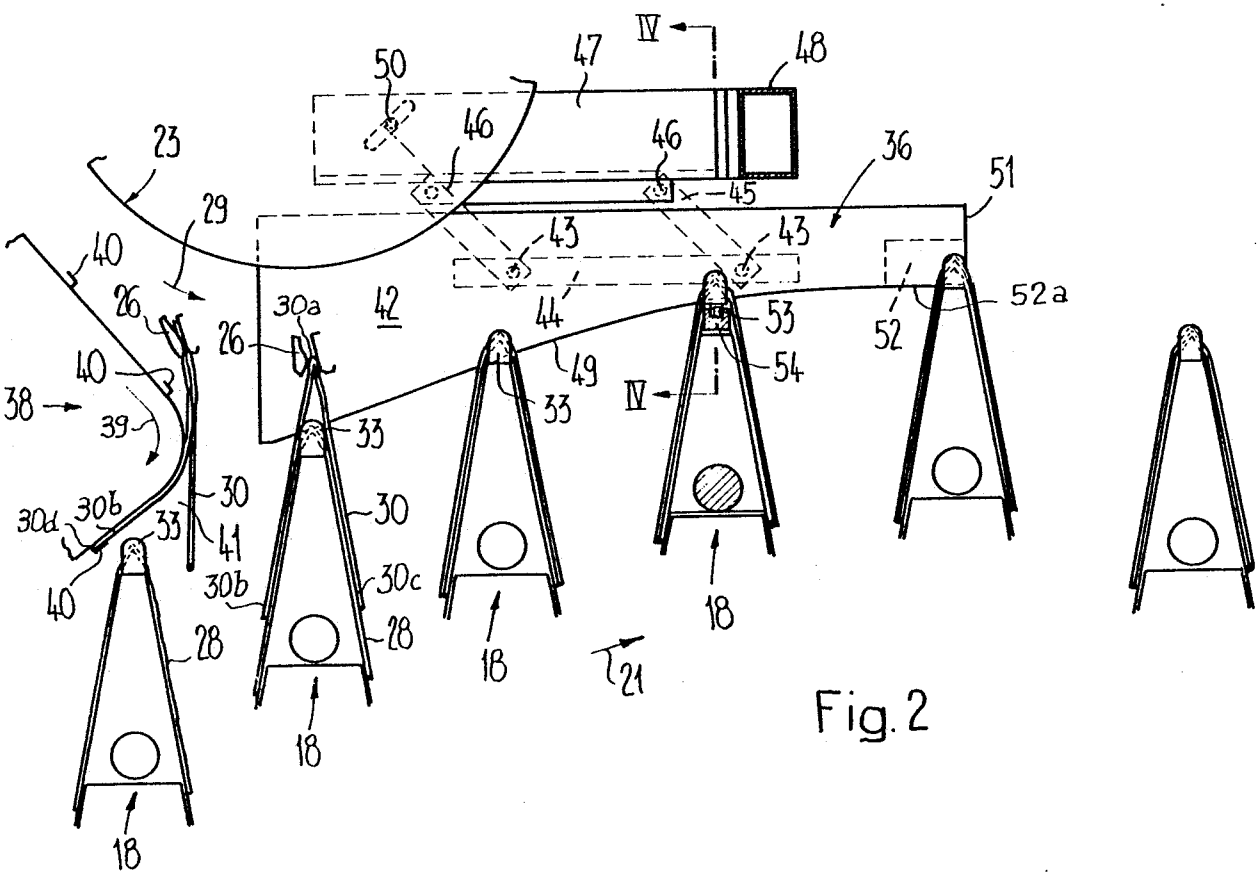
FIG. 2 again schematically illustrates an end view, looking in the direction of revolution or rotation of the collating apparatus, of a plurality of the collating conveyors at the region of transfer location of one of the infeeding devices or feed conveyors for delivering or infeeding the printed signatures or sheets.

At the transfer or transition regions of the infeed devices 22, 23 and 24 the printed signatures or sheets 28, 30 and 31 are appropriately opened by any suitable opening means, not particularly illustrated in FIG. 1, but to be discussed more fully with reference to FIG. 2, whereafter the gripper elements 26 themselves are opened so that the printed signatures 28, 30 and 31 arrive in straddling fashion or posture in contact with a related one of the collating conveyors 18. In analogous fashion the product withdrawal or outfeed device 25 engages by means of its grippers or gripper elements 27, the finished or finally collated products P at the terminal or end region of each of the collating conveyors 18, these finished products P being composed in each case of interleaved or stuffed printed signatures 28, 30 and 31. The thus engaged or grasped finished products P are likewise conveyed by the product withdrawal or outfeed device 25 in a suspended or hanging posture in the direction of the arrow 32 to a further suitable processing station, for instance to a binding machine or a stapling or stitching machine or the like.

Incorporated into or operatively correlated with each of the collating conveyors 18 is a feed or conveyor mechanism which is provided with pusher entrainment members 33 arranged at a substantially uniform or equidistant spacing from one another in the lengthwise direction of extent of the collating conveyors 18. Again, the details of the feed or conveyor mechanism and its drive are not important for understanding the teachings of the present invention and such structure has been extensively described in the aforementioned commonly assigned U.S. Pat. No. 4,684,116, granted Aug. 4, 1987. The pusher entrainment members 33 continuously move during their product pushing operation in the direction of the arrow 34, in other words, in the showing of FIG. 1 from the left toward the right thereof.

The conveying velocity of the infeed devices 22, 23 and 24 and the mutual spacing of the gripper elements 26 from one another are coordinated in such a manner to the circumferential or revolving velocity of the collating conveyors 18 and their mutual circumferential spacing from one another that a collating conveyor 18 is always essentially located beneath one of the grippers or gripper elements 26 when the latter are opened. Furthermore, the velocity of the feed or advance motion of the pusher entrainment members 33 and the spacing of the infeed devices 22, 23 and 24 from one another is coordinated or synchronized with respect to one another such that each pusher entrainment member 33, during one revolution of an associated collating conveyor 18, is advanced or forwardly shifted through a distance corresponding to the mutual spacing of the infeed devices 22, 23 and 24 from one another.

At this point it is reiterated that what has been described up to the present with respect to the collating apparatus 10, essentially coincides with the construction of collating apparatus disclosed in the aforementioned U.S. Pat. No. 4,684,116, granted Aug. 4, 1987. However, in contrast to the heretofore known construction of collating apparatus it is specifically noted that the collating apparatus 10 of the present development is provided with impact elements or impact means 35, 36 and 37 at the associated product transfer region of each of the infeed devices 22, 23 and 24, respectively. Each of these impact elements or impact means 35, 36 and 37 are essentially of the same construction. The construction of these impact elements 35, 36 and 37 and their mode of operation will be described in detail in conjunction with FIGS. 2, 3 and 4, where as a matter of convenience in the explanations given hereinafter there has been illustrated the transfer region of the infeed device 23 at the location of the associated impact element or impact means 36. Thus, a discussion of the impact element or impact means 36 should suffice to understand the construction and operation of the other impact elements or impact means 35 and 37.

Again to simplify the illustration, in FIG. 2 there has only been schematically portrayed the infeed device 23 and two of its grippers or gripper elements 26, each of which deliver or infeed a respective one of the printed signatures or sheets 30 in the direction of the arrow 29. At this juncture it is also remarked and it should be noted that the printed signatures 28, 30 and 31 are folded such as to have a "lap portion" or protruding portion, in other words, the one part of the printed signature, in the showing of FIG. 2 the trailing part identified by reference character 30*b*, is longer than and thus protrudes beyond the other part 30*c* of such depicted printed signatures 30.

A suitable product or signature opening device, generally indicated by reference character 38, is operatively associated with the transfer or transition region or location of the infeed device 23. This signature opening device 38 comprises a number of rearwardly open hook members or hooks 40 (FIG. 2) arranged at the same mutual spacing or distance from one another as the gripper elements 26 are spaced from one another. These hook members or hooks 40 revolve or rotate in the direction of the arrow 39 approximately with the same velocity as the velocity of movement of the gripper elements 26. As shown in FIG. 2, into each rearwardly open hook member 40 there extends or engages the longer, here trailing part 30*b* of an associated printed signature 30 and its edge 30*d* situated opposite the fold or fold portion 30*a*, so that the printed signature or sheet 30 is opened by forming an approximately wedge-shaped opening gap or void 41, as shown at the left-hand side of the illustration of FIG. 2. Entering or penetrating into this opening gap 41 is the associated collating conveyor 18, at which there already bears a prior deposited printed signature or sheet 28. This just-mentioned collating conveyor 18 appears at the extreme left-hand portion of the illustration of FIG. 2 and undertakes a revolving path of motion in the direction of the arrow 21. It will also be observed that the printed signature 30 located at the second collating conveyor 18 from the left side of the showing of FIG. 2, is already in the process of being dropped or released by the associated gripper element 26.

At this point, there will be described the construction of the one impact element or impact means 36, which, as will be recalled, is similarly designed as the other impact elements 35 and 37. Thus, as already noted, it will suffice to consider details of the impact element 36 and the comments to follow are hence applicable to the other impact elements 35 and 37. This impact element or impact means 36 essentially consists of a substantially flat or planar part, here shown as the part or component 42 formed, metal plating. As will be particularly apparent from the for instance, at least in part, or entirely of sheet metal or illustration of FIGS. 2 and 4, at the rear side or face 42*a* of this sheet metal part 42, which extends substantially perpendicular to the axis of revolution defined by the shaft member 14, there is secured in any suitable manner a beam portion or beam 44 provided with two protruding pins or projections 43. At these pins or projections 43 there is articulated the respective end 45*a* of each of two substantially parallel and equal length pendulum or swing members 45, the opposite ends 45*b* of which are both pivotable and axially displaceable and fixedly adjustably positionable upon a respective related stub shaft 46 defining pivot or pendulum axes extending substantially parallel to the axis of revolution defined by the shaft member 14. This adjustability of the impact element 36 along or in axial direction of the stub shafts or shaft elements 46 serves to accommodate the arrangement to different formats of the printed signatures or sheets which are to be collated. These stub shafts or shaft elements 46 protrude from a support or carrier element 47, here shown as a cantilever element, which, in turn, laterally protrudes from a carrier or support member 48 arranged substantially parallel to the shaft or shaft member 14 and, for instance, spanning the entire collating apparatus 10.

The edge or edge portion 49 of the sheet metal part or component 42 and which confronts the collating conveyors 18 is curved in conformity with, in other words, substantially opposite to the curvature of the path of revolving motion of the collating conveyors 18. If desired, the sheet metal part 42 which is suspended in the described manner to perform pendulum or oscillatory motions can contact at its lower edge or edge portion 49 the apex of a number of the collating conveyors 18. On the other hand, if the lower edge or edge portion 49 of the sheet metal part 42 should not contact the collating conveyors 18, then it is possible, as shown with broken or phantom lines in FIG. 2, to provide an adjustable and fixedly positionable impact or stop arrangement 50 by means of which there can be adjusted the minimum radial spacing of the lower edge or edge portion 49 of the sheet metal part or component 42 from the revolving path of travel of the collating conveyors 18. This sheet metal part of component 42 is, however, deflectable or shiftable in the direction of revolving motion, indicated by the arrow 21 in FIG. 2, of the collating conveyors 18.

Figure 3:
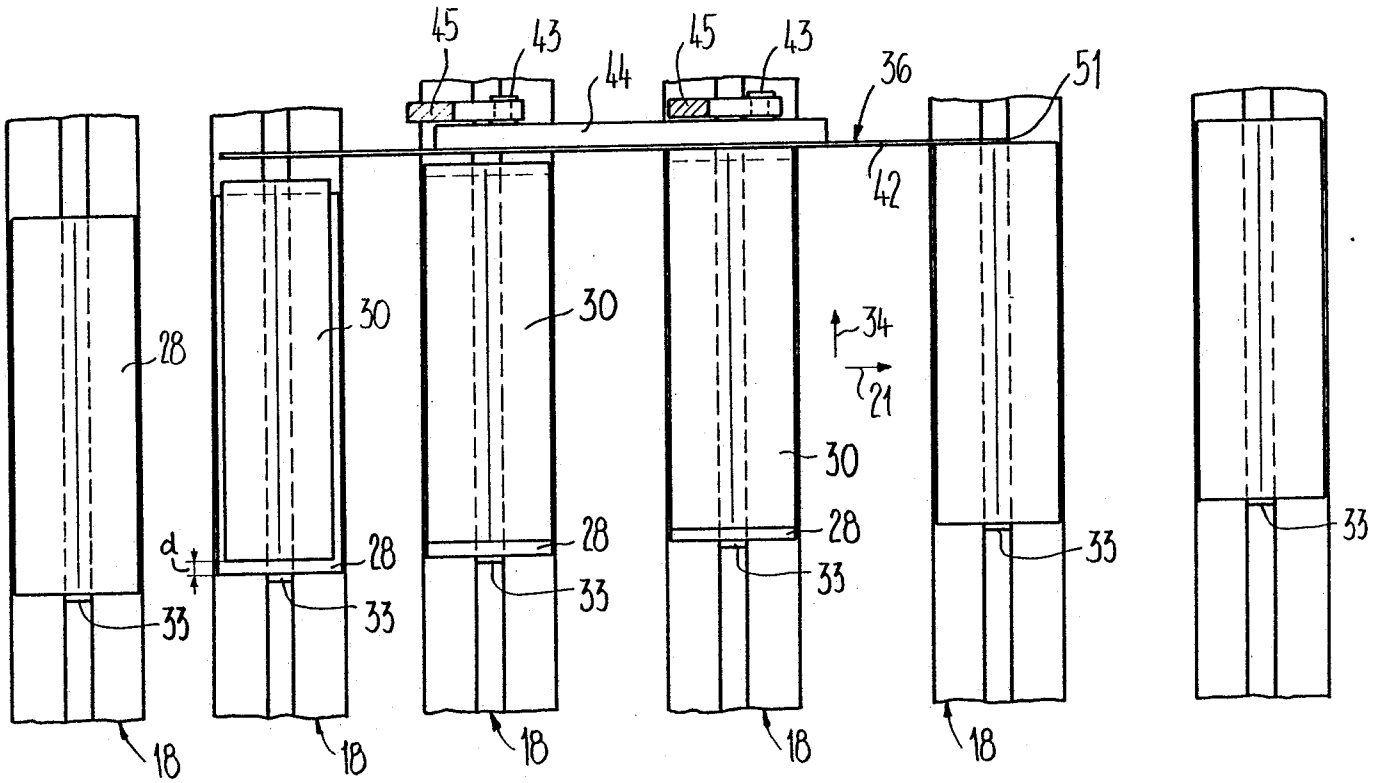
FIG. 3 is a simplified top plan view of the arrangement of FIG. 2.

In the description to follow there will be considered, based upon the illustration of FIG. 3, the mode of operation of the described arrangement. In the illustration of FIG. 3 there have been portrayed the six collating conveyors 18, depicted in FIG. 2, while conveniently omitting the showing of the infeed device 23 and the opening device 38 for ease of representation. In this FIG. 3 there will be clearly apparent, looking from the left towards the right, the different phases of operation. At the first collating conveyor 18 there reposes just one of the printed signatures 28 which is forwardly displaced or shifted by the associated pusher entrainment member 33 in the direction of the arrow 34. At the location of the second collating conveyor 18 there drops onto the already present and previously deposited printed signature 28, which has been forwardly displaced or shifted by the associated pusher entrainment member 33 in the direction of the conveying path of the associated collating conveyor 18, a further printed signature or sheet 30 at a location forwardly of the pusher entrainment member 30 by the amount of the spacing or distance d. This new or last deposited printed signature 30 is forwardly displaced or advanced at the moment it bears upon the prior deposited printed signature 28 by the friction prevailing between these two contacting printed signatures or sheets 28 and 30 and is immediately forwardly displaced or shifted in the direction of the arrow 34, it being noted that initially there still remains the spacing or distance d. This will be clearly discernible by inspecting the third and fourth collating conveyors 18 counted from the left-hand side of the illustration of FIG. 3. The printed signature or sheet 30 lying upon the fourth collating conveyor 18 now impacts against the impact element or impact means 36 and is prevented by such impact element 36 from undertaking any further forward or advance movement which otherwise would be accomplished due to the action of friction as explained above, whereas the printed signature or sheet 28 which is situated therebelow is further forwardly displaced or advanced. Now if finally the pusher entrainment member 33 has approached the impact element 36 at a spacing therefrom corresponding to the predeterminate format of the printed signatures or sheets, and this has been depicted for the fifth collating conveyor 18 counting from the left side of the illustration of FIG. 3, then the printed signature or sheet 28 (no longer now visible in the showing of FIG. 3) and the printed signature 30 are essentially coincidentally aligned or squared up or congruently positioned and simultaneously pass the end of the impact element 36.

Since with the exemplary embodiment under discussion the end edge or edge region 51 of the sheet metal part or component 42, as viewed in the direction of revolving motion of the collating conveyors 18, alters its position in the circumferential direction during an adjustment of the radial spacing of the lower edge or edge portion 49 from the revolving path of travel of the collating conveyors 18, it can be beneficial to form the end region or portion 52 (FIG. 2) of the impact element 36 from an elastically flexible material, as generally indicated by reference character 52*a*. This elastically flexible material 52*a* can be constituted by, for instance, by a rubber blade or plate or can consist of a row of brush bristles or equivalent structure, so that the printed signatures or sheets 28 and 30 which are coincidentally aligned or squared up with respect to one another, can pass beneath such end region 52 while elastically bending or deforming the same and without buckling or bowing or otherwise damming-up the printed signatures or sheets 28 and 30.

Finally, from the illustration of FIG. 4, it will be recognized that each collating conveyor 18 can comprise a link chain or chain member 53 which is guided in an associated guide rail 54 (FIG. 2) or equivalent structure and at which there are secured the pusher entrainment members 33 at a uniform mutual spacing from one another. These pusher entrainment members 33 protrude or project upwardly from the related link chain 53. A number of the chain links or link elements 53*a* of the link chain 53, and which number of chain links 53*a* lead the associated pusher entrainment member 33, are also provided with a respective support or contact element 55 in the form of a peaked roof. With the exemplary embodiment under discussion, the support surface of each collating conveyor 18 thus moves conjointly with the pusher entrainment member 33.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for collating folded printed products, especially signatures, comprising:

a plurality of collating conveyors for conveying the folded printed products along a respective conveying path in straddling relationship;

means mounting said plurality of collating conveyors in substantially parallel relationship to one another and at a substantially uniform circumferential spacing from one another for revolution about an axis of revolution in a predeterminate direction;

means for rotating said collating conveyors so as to revolve about said axis of revolution;

pusher entrainment members provided for each of said collating conveyors;

a plurality of product infeed devices for delivering the printed products individually so as to repose in straddling relationship upon the plurality of collating conveyors;

each of said product infeed devices transferring the folded printed products to the collating conveyors at a predeterminate transfer location;

impact means provided at the region of the transfer location of each product infeed device in order to force the printed products against an associated pusher entrainment member; and means for mounting each of said impact means for deflection in substantially the predeterminate direction of revolution of the collating conveyors.

2. The apparatus as defined in claim 1, wherein:

each of said impact means comprises a substantially planar impact element; and said mounting means mounting each impact element so as to extend substantially perpendicular to said axis of revolution of the collating conveyors and for accomplishing pendulum movements about axes disposed substantially parallel to the axis of revolution of the collating conveyors.

3. An apparatus for collating folded printed products, especially signatures, comprising:

a plurality of collating conveyors for conveying the folded printed products along a respective conveying path in straddling relationship;

means mounting said plurality of collating conveyors in substantially parallel relationship to one another and at a substantially uniform circumferential spacing from one another for revolution about an axis of revolution in a predeterminate direction;

means for rotating said collating conveyors so as to revolve about said axis of revolution;

pusher entrainment members provided for each of said collating conveyors;

a plurality of product infeed devices for delivering the printed products individually so as to repose in straddling relationship upon the plurality of collating conveyors;

each of said product infeed devices transferring the folded printed products to the collating conveyors at a predeterminate transfer location;

impact means provided at the region of the transfer location of each product infeed device in order to force the printed products against an associated pusher entrainment member;

means for mounting each of said impact means for deflection in substantially the predeterminate direction of revolution of the collating conveyors;

each of said impact means comprising a substantially planar impact element;

said mounting means mounting each impact element so as to extend substantially perpendicular to said axis of revolution of the collating conveyors and for accomplishing pendulum movements about axes disposed substantially parallel to the axis of revolution of the collating conveyors;

said mounting means for each of the impact elements comprising two substantially parallel pendulum members;

stationary support means; and each said impact element being suspended for pendulum motion by means of said two substantially mutually parallel pendulum members at said stationary support means.

4. The apparatus as defined in claim 3, wherein:

said stationary support means comprise cantilever means.

5. The apparatus as defined in claim 3, wherein:

each impact element has an edge confronting the collating conveyors;

said collating conveyors revolving about said axis of revolution along a predeterminate path of revolution; and said edge of each impact element being curved substantially opposite to said predeterminate path of revolution of the collating conveyors.

6. The apparatus as defined in claim 5, wherein:

said mounting means include means for adjusting and fixing in a selected adjusted position the spacing of the edge of each impact element confronting the collating conveyors from the path of revolution of the collating conveyors.

7. The apparatus as defined in claim 2, wherein:

each of said impact elements at least partially consists of metal plating.

8. An apparatus for collating folded printed products, especially signatures, comprising:

a plurality of collating conveyors for conveying the folded printed products along a respective conveying path in straddling relationship;

means mounting said plurality of collating conveyors in substantially parallel relationship to one another and at a substantially uniform circumferential spacing from one another for revolution about an axis of revolution in a predeterminate direction;

means for rotating said collating conveyors so as to revolve about said axis of revolution;

pusher entrainment members provided for each of said collating conveyors;

a plurality of product infeed devices for delivering the printed products individually so as to repose in straddling relationship upon the plurality of collating conveyors;

each of said product infeed devices transferring the folded printed products to the collating conveyors at a predeterminate transfer location;

impact means provided at the region of the transfer location of each product infeed device in order to force the printed products against an associated pusher entrainment member;

means for mounting each of said impact means for deflection in substantially the predeterminate direction of revolution of the collating conveyors;

each of said impact means comprising a substantially planar impact element;

said mounting means mounting each impact element so as to extend substantially perpendicular to said axis of revolution of the collating conveyors and for accomplishing pendulum movements about axes disposed substantially parallel to the axis of revolution of the collating conveyors;

each of said impact elements has an end region viewed with respect to the predeterminate direction of revolution of the collating conveyors; and said end region being elastically deflectable so that the collated printed products can pass beneath said end region.

9. The apparatus as defined in claim 8, wherein:

said end region of each of the impact elements comprises a rubber plate.

10. The apparatus as defined in claim 8, wherein:

the end region of each of said impact elements contains a row of brush bristles.

11. An apparatus for collating folded printed products, especially signatures, comprising:

a plurality of collating conveyors for conveying the folded printed products along a respective conveying path in straddling relationship;

means mounting said plurality of collating conveyors in substantially parallel relationship to one another and at a substantially uniform circumferentially spacing from one another for revolution about an axis of revolution in a predeterminate direction;

means for rotating said collating conveyors so as to revolve about said axis of revolution;

pusher entrainment members provided for each of said collating conveyors;

a plurality of product infeed devices for delivering the printed products individually so as to repose in straddling relationship upon the plurality of collating conveyors;

each of said product infeed devices transferring the folded printed products to the collating conveyors at a predetermined transfer location;

impact means provided at the region of the transfer location of each product infeed device in order to force the printed products against an associated pusher entrainment member;

means for mounting each of said impact means for deflection in substantially the predeterminate direction of revolution of the collating conveyors;

each of said impact means comprising a substantially planar impact element;

said mounting means mounting each impact element so as to extend substantially perpendicular to said axis of revolution of the collating conveyors and for accomplishing pendulum movements about axes disposed substantially parallel to the axis of revolution of the collating conveyors;

each impact element has an edge confronting the collating conveyors;

said collating conveyors revolving about said axis of revolution in a predeterminate path of revolution; and said edge of each impact element being curved substantially opposite to the predeterminate path of revolution of the collating conveyors.

12. The apparatus as defined in claim 11, wherein:

said mounting means include means for adjusting and fixing in desired adjusted position the spacing of the edge of each impact element confronting the collating conveyors from the path of revolution of the collating conveyors.

13. An apparatus for collating folded printed products, especially signatures, comprising:

a plurality of collating conveyors for conveying folded printed products in straddling relationship;

means mounting said plurality of collating conveyors at a substantially uniform spacing from one another for revolution about an axis of revolution;

means for rotting said collating conveyors so as to revolve about said axis of revolution;

pusher entrainment means provided for each of said collating conveyors;

a plurality of product infeed devices for delivering the printed products individually so as to repose in straddling relationship upon the plurality of collating conveyors;

each of said product infeed devices transferring the folded printed products to the collating conveyors at a predeterminate transfer location;

impact means provided at the region of the transfer location of each product infeed device in order to force the printed products against an associated pusher entrainment means; and means for mounting each of said impact means for displacement in substantially the direction of revolution of the collating conveyors.

* * * * *